US011419440B2

(12) United States Patent
Dennewald

(10) Patent No.: US 11,419,440 B2
(45) Date of Patent: Aug. 23, 2022

(54) ORTHOTIC DEVICE

(71) Applicant: DENNEROLL HOLDINGS PTY LTD, Cromer (AU)

(72) Inventor: Adrian Dennewald, Waverton (AU)

(73) Assignee: DENNEROLL HOLDINGS PTY LTD, Cromer (AU)

( * ) Notice: Subject to any disclaimer, the term of this patent is extended or adjusted under 35 U.S.C. 154(b) by 0 days.

(21) Appl. No.: 16/107,840

(22) Filed: Aug. 21, 2018

(65) Prior Publication Data

US 2019/0000248 A1 Jan. 3, 2019

Related U.S. Application Data

(60) Division of application No. 14/865,730, filed on Sep. 25, 2015, now Pat. No. 10,758,069, which is a continuation of application No. 12/468,547, filed on May 19, 2009, now Pat. No. 9,186,004, which is a division of application No. 11/524,560, filed on Sep. 21, 2006, now abandoned.

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/10; A47G 9/1081; A47G 9/109; A47G 2009/1018
See application file for complete search history.

(56) References Cited

U.S. PATENT DOCUMENTS

| | | | | | |
|---|---|---|---|---|---|
| 2,700,779 | A | * | 2/1955 | Tolkowsky | A47G 9/10 297/DIG. 1 |
| 2,835,905 | A | * | 5/1958 | Tomasson | A47G 9/10 5/632 |
| 2,880,428 | A | | 4/1959 | Forsland | |
| 3,648,308 | A | | 3/1972 | Greenawalt | |
| 3,829,917 | A | | 8/1974 | Da Laittre et al. | |
| 3,842,453 | A | | 10/1974 | Redfield | |
| D240,311 | S | | 6/1976 | Owens | |
| D241,104 | S | | 8/1976 | Copeland | |
| D245,298 | S | | 8/1977 | Brahm | |
| D247,406 | S | | 3/1978 | Stahl et al. | |
| D254,029 | S | * | 1/1980 | Barbagallo | 5/636 |
| D255,959 | S | | 7/1980 | Mitchell | |
| D256,408 | S | | 8/1980 | Nakisbendi | |
| 4,218,792 | A | | 8/1980 | Kogan | |
| D263,439 | S | | 3/1982 | Grube | |
| 4,424,599 | A | | 1/1984 | Hannouche | |
| D276,938 | S | * | 12/1984 | Pedersen | 5/636 |
| 4,494,261 | A | | 1/1985 | Morrow | |

(Continued)

FOREIGN PATENT DOCUMENTS

| | | | |
|---|---|---|---|
| CN | 88203329 | U | 12/1988 |
| CN | 2071030 | U | 2/1991 |

(Continued)

*Primary Examiner* — Peter M. Cuomo
*Assistant Examiner* — Ifeolu A Adeboyejo
(74) *Attorney, Agent, or Firm* — Mackey Law Firm PLLC

(57) ABSTRACT

An orthotic device 10 comprising a body 20 having a base 30, a first support surface 40. In use, the first support surface 40 supports a selected region of a patient's neck 70 whilst suspending the patient's head 80.

22 Claims, 3 Drawing Sheets

(56) References Cited

U.S. PATENT DOCUMENTS 4,550,459 A 11/1985 Endel et al.
D286,586 S 11/1986 Radford
D289,481 S * 4/1987 Reddick ..... 5/653
4,679,263 A * 7/1987 Honer ..... A47C 7/383 297/393
4,754,513 A * 7/1988 Rinz ..... A47G 9/0253 5/485
4,756,090 A 7/1988 Pedrow
4,759,089 A 7/1988 Fox
4,777,678 A 10/1988 Moore
4,805,603 A 2/1989 Cumberland
4,821,355 A 4/1989 Burkhardt
4,829,614 A 5/1989 Harper
4,832,007 A 5/1989 Davis, Jr. et al.
4,916,765 A 4/1990 Castronovo, Jr.
D308,141 S 5/1990 Genova et al.
4,928,335 A 5/1990 Pedrow
D310,609 S 9/1990 Burkhardt
4,956,886 A 9/1990 Sarkozi
D314,284 S 2/1991 Cohen
D314,685 S 2/1991 Hudson
D317,840 S 7/1991 Jagdat
5,123,132 A 6/1992 Dixon
5,127,120 A * 7/1992 Mason ..... A47D 15/006 297/219.12
D328,682 S 8/1992 Camey
D334,107 S 3/1993 Johnson
D337,210 S 7/1993 Silverman
5,237,714 A 8/1993 Baron
D341,267 S 11/1993 Caldwell
5,279,310 A * 1/1994 Hsien ..... A61F 5/01 128/DIG. 20
D361,905 S 9/1995 Adams et al.
5,457,832 A 10/1995 Tatum
5,481,771 A 1/1996 Burk, IV
D366,966 S 2/1996 Bonaddio et al.
D370,821 S 6/1996 Mata
D372,805 S 8/1996 Bonaddio et al.
D375,417 S 11/1996 Bonaddio et al.
5,630,651 A 5/1997 Fishbane
5,644,809 A 7/1997 Olson
5,662,597 A 9/1997 Chitwood
5,694,726 A 12/1997 Wu
5,727,267 A 3/1998 Keilhauer
5,797,154 A * 8/1998 Contreras ..... A47G 9/1081 5/636
5,819,485 A 10/1998 Lane et al.
D400,386 S 11/1998 Keilhauer
D400,387 S 11/1998 Denney
D404,238 S * 1/1999 Keilhauer ..... D6/601
D405,854 S 2/1999 Grant
D410,744 S 6/1999 Banister
5,916,185 A 6/1999 Chitwood
D417,579 S 12/1999 Tarquinio
6,000,401 A 12/1999 Herrick
D418,897 S 1/2000 Rembles
D444,560 S 7/2001 Berglund
D447,253 S 8/2001 Gardner
D447,577 S 9/2001 Gardner
D447,805 S 9/2001 Siegal
D448,228 S 9/2001 David
D448,581 S 10/2001 Branch
D448,582 S 10/2001 Branch
6,345,401 B1 2/2002 Frydman
D454,180 S 3/2002 Wessels
6,381,784 B1 * 5/2002 Davis ..... A61G 7/07 5/636
D458,049 S 6/2002 Prins et al.
D461,649 S 8/2002 Prins et al.
6,446,288 B1 9/2002 Pi
6,471,726 B2 10/2002 Wang
D473,063 S 4/2003 Pappas
D480,484 S 10/2003 Kakhiani
D484,618 S 12/2003 Kakhiani
D486,247 S 2/2004 Eichner et al.
6,704,957 B2 3/2004 Rhodes
D491,282 S 6/2004 Kakhiani
6,751,818 B2 6/2004 Troop
6,817,049 B1 11/2004 Hall
D499,816 S 12/2004 Eichner et al.
D510,631 S 10/2005 Hsu
6,981,288 B1 1/2006 Hu
7,013,512 B1 3/2006 Hsu
D518,576 S 4/2006 Sevier et al.
D521,301 S 5/2006 Dickson
7,082,633 B1 8/2006 Maarbjerg
D531,315 S 10/2006 Caudra
7,210,178 B2 * 5/2007 DiGirolamo ..... A47G 9/1081 5/636
D551,355 S 9/2007 Tao
D555,408 S 11/2007 Keilhauer
D555,741 S 11/2007 Wachtfogel
D573,830 S 7/2008 Kalatsky
D595,527 S * 7/2009 Carter ..... D6/601
D597,743 S 8/2009 Skinner
7,578,015 B1 8/2009 Wilson
D608,102 S 1/2010 Kemm
D615,210 S 5/2010 Woodhams et al.
D618,354 S 6/2010 Francucci et al.
D619,404 S 7/2010 Castillo
D623,305 S 9/2010 Tao
D634,961 S 3/2011 Lowery
D635,265 S 3/2011 Coffey et al.
D635,271 S 3/2011 Azar et al.
D637,030 S 5/2011 Khandai
D638,646 S 5/2011 Penza
D646,498 S 10/2011 Blasini et al.
D651,368 S 12/2011 Seliskar et al.
8,161,588 B1 4/2012 Anson
D664,256 S 7/2012 Dennewald
D665,503 S 8/2012 Dennewald
D672,879 S 12/2012 Hawkins
D678,539 S 3/2013 Narson
8,393,027 B2 3/2013 Weisberg
D680,654 S 4/2013 Borreli
D681,994 S 5/2013 Morgan, II
D684,394 S 6/2013 Leemkuil
D688,379 S 8/2013 Ehlers
D701,710 S 4/2014 Martinez
8,713,732 B2 5/2014 Dennewald
D708,754 S 7/2014 Harangvolgyi
D710,021 S 7/2014 Blaine et al.
D715,452 S 10/2014 Schiavon
D736,397 S 8/2015 McAviney et al.
D739,036 S 9/2015 McAviney et al.
9,186,004 B2 11/2015 Dennewald
D745,786 S 12/2015 Ko
D748,406 S 2/2016 Pham
D751,314 S 3/2016 Meyer
D758,100 S 6/2016 Pham
D764,062 S 8/2016 Dennewald
D804,598 S 12/2017 Albert
D859,664 S 9/2019 Dennewald
10,561,561 B2 2/2020 Kim
2004/0006822 A1 1/2004 Milligan
2004/0068799 A1 4/2004 Wilson
2004/0194214 A1 10/2004 Troop
2005/0060807 A1 3/2005 Kaizuka
2005/0177944 A1 8/2005 Kang et al.
2007/0101503 A1 5/2007 Dennewald
2007/0113348 A1 5/2007 Ramaiah
2008/0115284 A1 5/2008 Hiatt
2014/0076330 A1 3/2014 Rolle et al.

FOREIGN PATENT DOCUMENTS

CN 2505048 Y 8/2002
CN 2812877 Y 9/2006
CN 2824881 Y 10/2006
CN 2850576 Y 12/2006

* cited by examiner

ORTHOTIC DEVICE

FIELD OF INVENTION

The present invention relates to orthotic devices. In a particular form, the present invention relates to an orthotic device for stretching tissue within the neck of a patient.

BACKGROUND OF THE INVENTION

Chiropractors have for many years studied the biomechanics of the spine and the adverse effects of reduced motion in the joints of the spine. A person's physical movement can become restricted when soft tissue structures alter, most commonly due to contraction of the soft tissue structures. These soft tissue structures comprise, amongst other things, ligaments, joint capsules, muscles and tendons.

Prolonged poor posture or trauma can create stresses that effect normal motion of the spine. These stresses can encourage structural changes, altering the spine's optimal functional position. This can result is inefficient biomechanics and a decrease in the movement in the joints of the spine.

When structural changes occur in the spine, the surrounding soft tissue structures can also change due to their altered position. This altered position of the spine and surrounding soft tissue structures exacerbates poor movement, encouraging the spinal joints further away from optimal functioning. In the cervical spine, this process is evident when the normal lordotic position is decreased. This can be visualised via diagnostic imaging using an X-ray analysis.

One proposed solution has comprised a neck support for promoting a structural positional change in the spine. This neck support comprises two rigid wall portions meeting at an apex forming a generally triangular shape.

In operation, the patient lies on the flat surface with their neck contacting the apex of the neck support such their head is suspended above the surface.

However, there are problems associated with this form of neck support. To achieve a structural positional change in the spine, the wall portions are made from a rigid plastic and extend at an angle of approximately seventy degrees relative to the surface, applying an excessive tractional force on the ligaments of the neck when in use. This excessive force applied to the neck can cause significant discomfort to the patient.

Furthermore, due to the sharp angle which the wall portions meet at the apex, global over-extension of the neck can occur due to the small surface area in contact with the neck, leading to further discomfort for the user.

Moreover, the apex of the neck support can only contact upper portions of the neck because the wall portions cannot be placed lower down due to the angle of the wall portions. This can be unsuitable for particular patients requiring stretching of the lower portion of the neck.

The present invention seeks to ameliorate at least some of the above mentioned problems.

Furthermore, the present invention seeks to provide an orthotic device which in use is more comfortable for the patient.

Additionally, the present invention seeks to provide an orthotic device which in use can stretch various portions of the neck, rather than achieve a structural positional change in the spine.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

SUMMARY OF THE INVENTION

According to a first aspect of the present invention there is provided an orthotic device comprising:

a body having a base and a first support surface, wherein in use, the first support surface supports a selected region of a patient's neck whilst suspending the patient's head.

In one embodiment, the first support surface is made from cushioning material.

In another form, the orthotic device is made from a cushioning material. Preferably, the cushioning material compresses from between 5% to 35% when supporting the selected region of the patient's neck, and more preferably between 10% to 25% when supporting the selected region of the patient's neck.

In one form, the cushioning material consists of a synthetic foam such as for example a closed cell cross-linked polyethylene foam.

In use, the patient lies on a substrate surface such that the patient is in a supine position when the patient's neck is supported by the support surface and the head is suspended above the substrate.

In one form, the first support surface is in the form of a bulbous protrusion extending from the body.

In another form, the bulbous portion is a substantially half cylindrical protrusion extending from the body.

In one embodiment the base is an elongate planar surface.

In another embodiment the orthotic device comprises side faces extending from the base to the first support surface, and wherein at least one side face tangentially meets with the first support surface.

In one form, the surface area of the first support surface in contact with the patient's neck is less than the surface area of the base in contact with the substrate surface.

According to another aspect, the orthotic device may comprise a second support surface for supporting a region of the patient lower down than the selected region of the patient's neck to restrict cervical over-extension, wherein the spacing between an apex of the first support surface and the base is greater than spacing between the second support surface and the base. Preferably, the second support surface supports a region of the patient's neck immediately lower than the selected region.

In one embodiment, the first support surface is in the form of a first convex surface and the second support surface is in the form of a first concave surface.

In another embodiment the first convex surface comprises a degree of curvature which is less than the degree of curvature of the first concave surface.

Preferably, the first convex surface tangentially meets the first concave surface and the first concave surface is part of a recess in the body.

Preferably, the recess is substantially a quarter cylindrical recess in the body, wherein the half cylindrical protrusion comprises a radius greater than a radius of the quarter cylindrical recess.

According to another aspect, the orthotic device comprises a third support surface adjacent the first contact surface.

In one form, the third contact surface comprises a second convex surface and a second concave surface.

In another form, the second concave surface is adjacent the first convex surface, and the second concave surface is adjacent the second convex surface.

In one embodiment, the orthotic device comprises side faces extending from the base to the first, second and third support surfaces, and wherein at least one side face tangentially meets with the second convex surface.

In another embodiment, the second convex surface tangentially meets the second concave surface.

In one form, the apex of the second convex surface tangentially meets the second concave surface.

In another form, spacing between the apex of second convex surface and the base is less than spacing between the first convex surface and the base.

In one embodiment, the degree of curvature of second convex surface is greater than the degree of curvature of the first convex surface.

In another embodiment, the degree of curvature of the second concave surface is greater than the degree of curvature of the first and second convex surfaces and the first-concave surface.

According to another aspect the present invention provides an orthotic device comprising a body having a base and a first support surface for supporting a selected region of a patient's neck, wherein the orthotic device is made from a cushioning material.

In one embodiment the first support surface operates as a fulcrum for suspending the patient's head above a substrate surface.

According to another aspect of the present invention, a method is provided for stretching a patient's neck using an orthotic device, the orthotic device comprising a body having a base and a first support, wherein the method comprises the patient lying in a supine position on a substrate surface such that the support surface of the orthotic device supports a selected region of a patient's neck whilst suspending the patient's head above the substrate surface.

In one embodiment, the orthotic device comprises a second support surface for supporting a portion of the neck located lower than the selected region of the neck supported by the first support surface, the method comprising the patient positioning the second support surface the portion of the neck lower than the selected region to restrict cervical over-extension.

DESCRIPTION OF PREFERRED EMBODIMENTS

Figure 1:
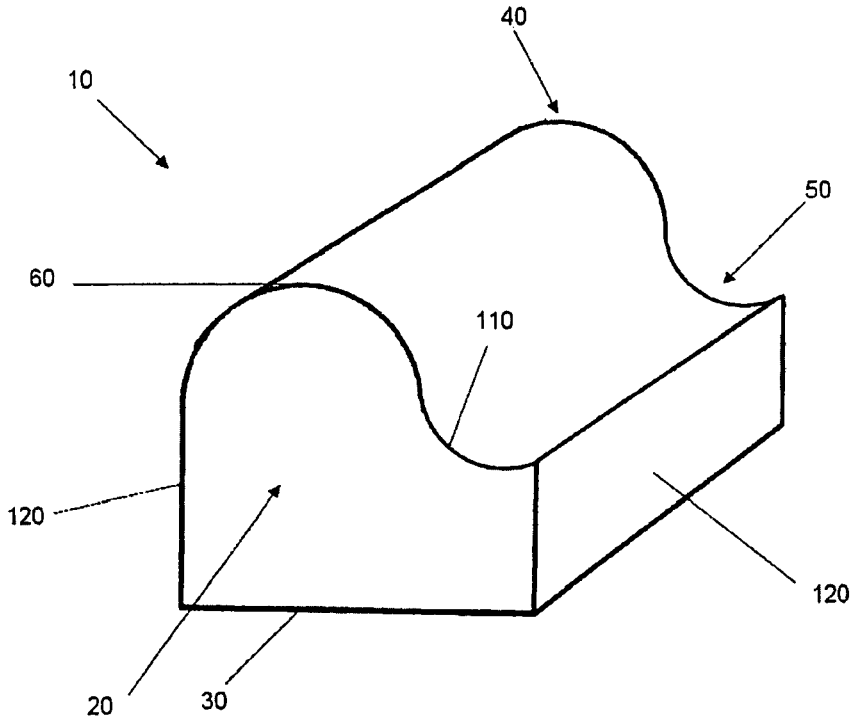
FIG. 1 is a perspective view of one embodiment of an orthotic device according to the present invention.
Figure 2:
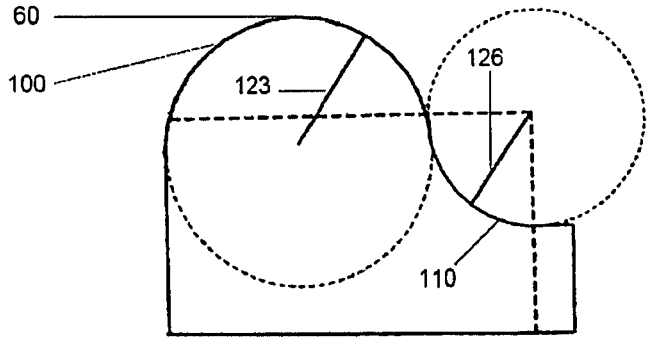
FIG. 2 is a side elevational view of the embodiment of FIG. 1.
Figure 3:
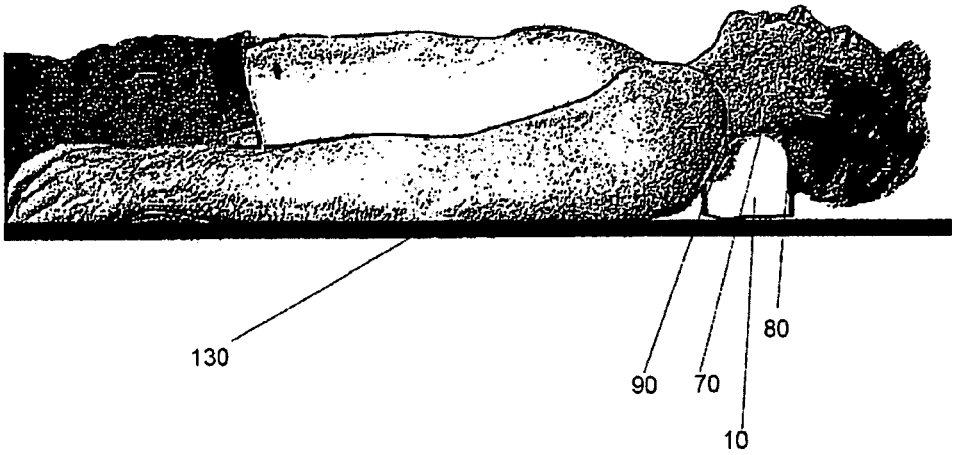
FIG. 3 is a side elevational view of the embodiment of FIG. 1 in use.

FIGS. 1 to 3 show an example of an orthotic device 10 according to a first preferred embodiment of the present invention. The orthotic device 10 comprises a body 20 comprising a base 30 and a first support surface 40. In use, the first support surface 40 supports a selected region of a patient's neck 70 whilst suspending the patient's head 80. The first support surface 40 acts as a positional fulcrum such as to gently bend the patient's neck 70 over the first support surface 40 whilst suspending the patient's head 80 above a substrate surface 130.

In one form, the orthotic device 10 comprises a second support surface 50 for supporting either a region of the patient's neck located lower than the selected region 70 supported by the first support surface 40 or the patient's shoulders 90 such as to restrict cervical over-extension. Spacing between an apex 60 of the first support surface 40 and the base 30 is greater than spacing between the second support surface 50 and the base 30.

The first support surface 40 is in the form of a first convex surface 100 and the second support surface 50 is in the form of a first concave surface 110. The first convex surface 100 and the first concave surface 110 are shaped to support the curvature of a patient's neck 70, head 80 and shoulders 90. The first convex surface 100 comprises a degree of curvature which is less than the degree of curvature of the first concave surface 10. In this form the first convex surface 100 tangentially meets the first concave surface 110 to provide a gradual curvature of the support surfaces. This tangential meeting of the convex support surface 100 and the concave support surface 110 allows the first support surface 40 to be placed at selected regions of the patient's neck 80.

As clearly shown in the side view of the orthotic device 10 in FIG. 2, the first convex surface 100 is part of a bulbous portion of the body 20 and the first concave surface 110 is part of a recess in the body 20. In one form the bulbous portion is substantially a half cylindrical protrusion extending from the body 20 and the recess is substantially a quarter cylindrical recess in the body. As illustrated by the dotted lines in FIG. 2, the half cylindrical protrusion comprises radius 123 greater than a radius 126 of the quarter cylindrical recess where the degree of curvature of the quarter cylindrical recess is greater than the degree of curvature of the half cylindrical protrusion.

In one form, the orthotic device 10 comprises side faces 120 extending from the base 30 to the first support surface 40 and second support surface 50. At least one side face 120 tangentially meets with the first convex surface 100. At least one side face 120 is substantially vertical in a normal position and wherein the base 30 is orthogonal to the at least one side face 120. Additionally, the base 30 comprises a substantially elongate planar surface such as to provide a stable support surface to rest on a substrate surface 130 which the patient lies upon in use. In use, the surface area of the first support surface 40 in contact. with the patient is less than the surface area of the elongate planar surface in contact with substrate surface.

As shown clearly in the side view of FIG. 2, the first convex surface 100 tangentially meets at least one of the side faces 120. This tangential meeting between the first convex surface 100 and the adjacent side face 120 allows for the patient's head to be supported whilst being suspended, restricting cervical over-extension. By attempting to restrict cervical over-extension, an increase in movement of the patient's neck 70 within optimal limits can be obtained and additionally improve the functional relationship between soft tissue structures and the joints in the spine. Furthermore, by providing a large contact surface in the form of a bulbous portion of the body 20, cervical over-extension is further reduced.

The first support surface 40 may be made from a cushioning material. Alternatively the first and second support surface 40, 50 may be made from cushioning material or substantially the entire orthotic device 10 may made from a cushioning material. The cushioning material may be resilient. In use, the orthotic device 10 resiliently compresses such that the weight of the patient's neck 70, head 80 and shoulders 90 are supported. This configuration alleviates neck soreness caused by more rigid material used in prior art devices. Additionally, due to the bulbous portion of the orthotic device 10, the patient's head 80 is slightly lifted from the substrate surface 130 whilst the patient lies in a supine position, suspending the patient's head 80 from the substrate surface 130 and applying a gentle stretch to the patient's neck 70 and spine. The cushioning material can resiliently compress between 5% to 35% when supporting the selected region of the patient's neck 70. Preferably, the cushioning material compresses between 10% to 25% when supporting the selected region of the patient's neck. In one form, the resiliently cushioned material can take the form of synthetic foam. The synthetic foam may be in the form of closed cell cross-linked polyethylene foam.

Figure 4:
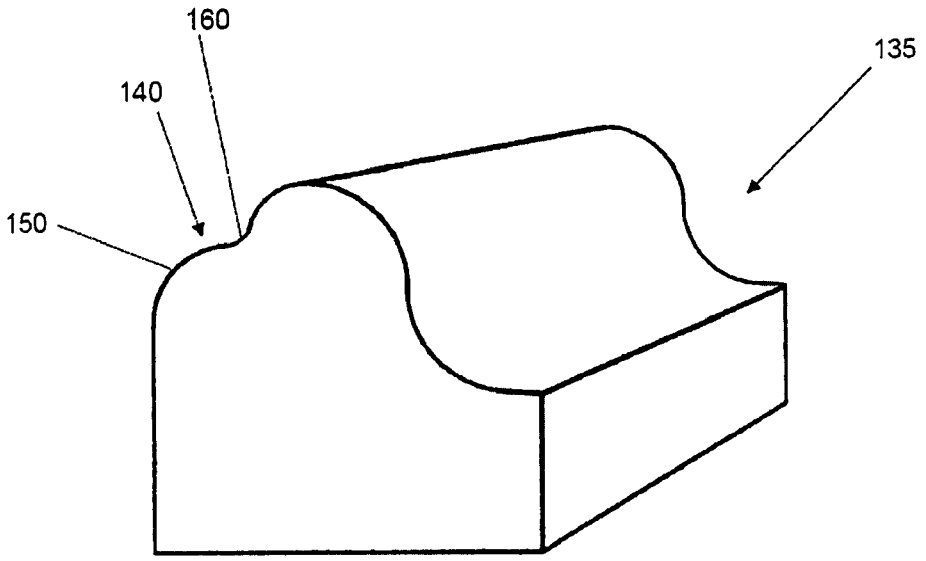
FIG. 4 is a perspective view of a second embodiment of an orthotic device according to the present invention.
Figure 5:
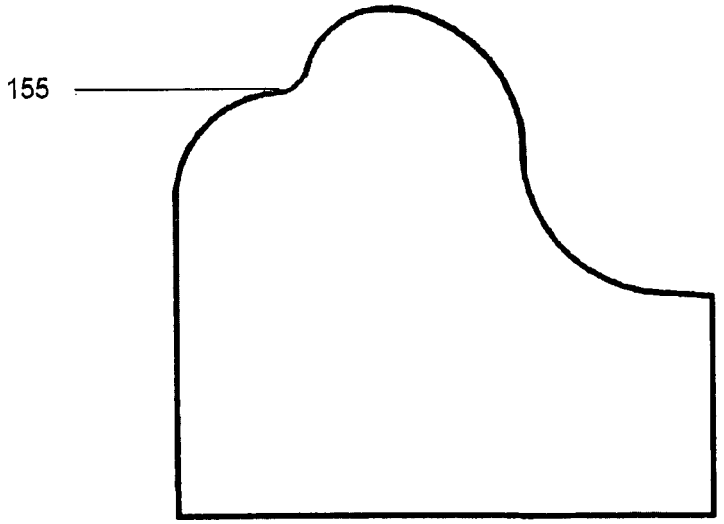
FIG. 5 is a side elevational view of the embodiment of FIG. 4.

Another example of the orthotic device 135 is shown in FIGS. 4 and 5. FIG. 4 shows a perspective view of the orthotic device 135 and FIG. 5 shows a side view of the orthotic device 135. The orthotic device 135 comprises a third support surface 140 adjacent the first contact surface 40 for supporting the back of the patient's head 80. The third support surface 140 forms a generally higher positional fulcrum point at the first convex surface 100. The third support surface 140 comprises a second convex surface 150 and a second concave surface 160. The second concave surface 160 is located adjacent the first convex surface 100, and the second concave surface 160 is located adjacent the second convex surface 150. The side faces 120 extend from the base to the first 40, second 50 and third support surfaces 140. When the patient's neck 70 is supported by the first support surface 40 and third support surface 140, a gap between the first convex surface 100 and the second convex surface 150 leaves a portion of the patient's neck 80 failing to be in contact with the orthotic device 135 such as to focus the stretching applied to the patient's neck 80 in contact with the first support surface 40.

The second convex surface 150 tangentially meets the second convex surface 160. This provides a gradual curved surface for supporting the back of the patient's head 80. An apex 155 of the second convex surface 150 tangentially meets the second concave surface 160. In this form, spacing between the apex 155 of second convex surface 150 and the base 30 is less than spacing between the first convex surface 100 and the base 30 such as to suspend the patient's head 70 above the substrate surface 130. The degree of curvature of second convex surface 150 in this form is greater than the degree of curvature of the first convex surface 100. Additionally, the degree of curvature of the second concave surface 160 is greater than the degree of curvature of the first convex surface 100, the second convex surface 150 and the first concave surface 110.

Optional embodiments of the present invention may also be said to broadly consist in the parts elements and features referred to or indicated herein, individually or collectively, in any or all combinations of two or more of the parts, elements or features, and wherein specific integers are mentioned herein which have known equivalents in the art to which the invention relates, such known equivalents are deemed to be incorporated herein as if individually set forth.

Although a preferred embodiment has been described in detail, it should be understood that various changes, substitutions, and alterations can be made by one of ordinary skill in the art without departing from the scope of the present invention.

The invention claimed is:

1. An orthotic device, comprising:

a body having a base and at least one support surface disposed above the base; and front and rear terminal ends that extend from the base to the at least one support surface;

wherein the at least one support surface comprises a first convex surface having a first diameter and an apex, a second convex surface having an apex, and a concave surface having a second diameter;

wherein the first convex surface is disposed between the second convex surface and the front terminal end;

wherein at least a portion of the second convex surface is disposed between the first convex surface and the rear terminal end;

wherein the concave surface is disposed between the second convex surface and the front terminal end;

wherein the apex of the first convex surface is vertically farther from the base than the apex of the second convex surface;

wherein the device is configured so that, when the device is located between a substrate surface and a patient's neck with the patient in a supine position and at least a portion of the front terminal end of the device in contact with the patient's lower neck and/or shoulders, at least a portion of the patient's head is suspended above the substrate surface rearwardly of the rear terminal end; and the first convex surface supports and stretches the patient's neck;

wherein the base has a depth from the front terminal end to the rear terminal end; and wherein the depth is less than the sum of the first and second diameters.

2. The orthotic device of claim 1, wherein at least the first convex surface is made from a cushioning material.

3. The orthotic device of claim 1, wherein the base is an elongate planar surface.

4. The orthotic device of claim 1, wherein the orthotic device comprises at least one side face that tangentially meets with the at least one support surface.

5. The orthotic device of claim 1, wherein the device is configured so that a surface area of the first convex surface in contact with the patient's neck is less than a surface area of the base in contact with the substrate surface.

6. The orthotic device of claim 1, wherein the concave surface is configured to support at least one of the patient's lower neck and a portion of the shoulders to restrict cervical over-extension.

7. The orthotic device of claim 6, wherein the concave surface is curved and wherein the first convex surface tangentially meets the concave surface.

8. The orthotic device of claim 1, wherein the concave surface is disposed between the first convex surface and the second convex surface.

9. The orthotic device of claim 8, further comprising a second concave surface disposed between the first convex surface and the front terminal end.

10. The orthotic device of claim 1, wherein the second convex surface is at least partially curved and the rear terminal end tangentially meets with the second convex surface.

11. The orthotic device of claim 8, wherein the second convex surface is curved and tangentially meets the concave surface.

12. The orthotic device of claim 8, wherein the apex of the second convex surface tangentially meets the concave surface.

13. The orthotic device of claim 1, wherein the first convex surface is at least partially curved, and wherein the second convex surface is at least partially curved and has a degree of curvature greater than a degree of curvature of the first convex surface.

14. The orthotic device of claim 8, wherein the concave surface and the first and second convex surfaces are at least partially curved, and wherein a degree of curvature of the concave surface is greater than a degree of curvature of at least one of the first and second convex surfaces.

15. An orthotic device, comprising:

a body having a base, front and rear terminal ends, and at least one support surface disposed above the base;

wherein the at least one support surface comprises a first convex surface having a first diameter and an apex and a concave surface having a second diameter and an apex;

wherein the first convex surface is disposed between the concave surface and the rear terminal end;

wherein at least a portion of the concave surface is disposed between the first convex surface and the front terminal end;

wherein the apex of the first convex surface is vertically farther from the base than the apex of the concave surface;

wherein the device is configured to suspend at least a portion of a supine patient's head rearwardly of the device, and the first convex surface is configured to support and stretch the patient's neck, when the device is disposed between the patient's neck and a substrate surface with the base in contact with the substrate surface, at least a portion of the first convex surface in contact with the patient's neck and at least a portion of the front terminal end in contact with the patient's shoulders;

wherein the base has a depth from the front terminal end to the rear terminal end; and wherein the depth is less than the sum of the first and second diameters.

16. The orthotic device of claim 15, wherein the first convex surface is curved.

17. The orthotic device of claim 15, wherein the device is configured so that no portion of the device extends rearwardly of the patient's head when the device is disposed between the patient's neck and a substrate surface so that the base is in contact with the substrate surface, at least a portion of the first convex surface is in contact with the patient's neck and at least a portion of the front terminal end is in contact with the patient's shoulders.

18. The orthotic device of claim 15, wherein the base is wider than it is deep.

19. The orthotic device of claim 1, wherein the second convex surface comprises at least a portion of the rear terminal end.

20. The orthotic device of claim 1, wherein the second convex surface is at least partially curved.

21. An orthotic device, comprising:

a body having a base and at least one support surface disposed above the base; and front and rear terminal ends that extend from the base to the at least one support surface;

wherein the at least one support surface comprises a first convex surface having a first diameter and an apex, a second convex surface having an apex, and a concave surface having a second diameter;

wherein the first convex surface is disposed between the second convex surface and the front terminal end;

wherein at least a portion of the second convex surface is disposed between the first convex surface and the rear terminal end;

wherein the concave surface is disposed between the second convex surface and the front terminal end;

wherein the apex of the first convex surface is vertically farther from the base than the apex of the second convex surface;

wherein the device is configured so that, when the device is located between a substrate surface and a patient's neck with the patient in a supine position and the front terminal end of the device disposed beneath the patient's lower neck and/or shoulders, at least a portion of the patient's head is suspended above the substrate surface rearwardly of the rear terminal end of the device; and the first convex surface supports and stretches the patient's neck;

wherein the base has a depth from the front terminal end to the rear terminal end; and wherein the depth is less than the sum of the first and second diameters.

22. The orthotic device of claim 1, wherein the device is configured so that a vertical distance between the substrate surface and a lowermost point on the portion of the patient's head suspended rearwardly of the rear terminal end is less than a vertical distance between the substrate surface and the concave surface.

* * * * *